US007771180B2

(12) United States Patent
Cho et al.

(10) Patent No.: US 7,771,180 B2
(45) Date of Patent: Aug. 10, 2010

(54) COMPRESSOR AND OIL SEPARATION DEVICE THEREFOR

(75) Inventors: Yang-Hee Cho, Seoul (KR); Nam-Kyu Cho, Seoul (KR); Dong-Koo Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 117 days.

(21) Appl. No.: 11/856,794

(22) Filed: Sep. 18, 2007

(65) Prior Publication Data

US 2008/0206084 A1 Aug. 28, 2008

(30) Foreign Application Priority Data

Feb. 23, 2007 (KR) ..... 10-2007-0018679

(51) Int. Cl.
*F01C 1/02* (2006.01)

(52) U.S. Cl. ..... 418/55.6; 418/96

(58) Field of Classification Search ..... 418/55.6, 418/DIG. 1, 83–101
See application file for complete search history.

(56) References Cited

U.S. PATENT DOCUMENTS 3,922,114 A * 11/1975 Hamilton et al. ..... 417/366
4,343,599 A 8/1982 Kousokabe ..... 418/55.6
4,755,114 A * 7/1988 Shibayashi et al. ..... 418/55.6
4,889,471 A 12/1989 Izunaga et al. ..... 418/55.6
5,174,740 A 12/1992 Jang ..... 418/55.6
5,219,281 A * 6/1993 Caillat et al. ..... 418/55.6
5,263,822 A 11/1993 Fujio ..... 418/55.6
5,310,326 A * 5/1994 Gui et al. ..... 418/76
5,370,513 A 12/1994 Fain ..... 418/99
5,591,018 A 1/1997 Takeuchi et al. ..... 417/366
5,772,411 A 6/1998 Crum et al. ..... 418/55.1
5,775,120 A 7/1998 Inazuka et al. ..... 62/259
5,775,123 A 7/1998 Wakayama et al. ..... 62/407
5,947,373 A 9/1999 Saito et al. ..... 237/2
6,042,346 A * 3/2000 Doi ..... 417/371
6,106,254 A 8/2000 Hirooka et al. ..... 418/55.6
6,149,413 A 11/2000 Lifson ..... 418/99
6,182,460 B1 2/2001 Herndandez et al. ..... 62/262

(Continued)

FOREIGN PATENT DOCUMENTS

JP 62-135693 6/1987

(Continued)

OTHER PUBLICATIONS

Written Opinion of the International Searching Authority, dated Dec. 28, 2007.

(Continued)

*Primary Examiner*—Thomas Denion
*Assistant Examiner*—Douglas J. Duff
(74) *Attorney, Agent, or Firm*—Ked & Associates LLP

(57) ABSTRACT

A compressor and oil separation device therefore are provided. The oil separation device is integrated with a compressor and includes a first case having a refrigerant inlet into which a refrigerant mixed with oil is sucked and an oil recollecting member through which oil separated from the refrigerant flows, and a second case positioned outside of the first case and having a refrigerant outlet through which refrigerant separated from an oil is discharged. With this constructions, a pipe connecting the compressor and a separate oil separation device is not required, thereby reducing fabrication costs and facilitating installation.

6 Claims, 8 Drawing Sheets

U.S. PATENT DOCUMENTS

| | | | | |
|---|---|---|---|---|
| 6,309,198 | B1 | 10/2001 | Zamudio et al. | 418/55.6 |
| 6,374,492 | B1 | 4/2002 | Myung et al. | 28/890.3 |
| 6,386,840 | B1 | 5/2002 | Williams et al. | 418/55.6 |
| 6,412,298 | B2 | 7/2002 | Kang et al. | 62/262 |
| 6,422,843 | B1 | 7/2002 | Sun et al. | 418/99 |
| 6,527,085 | B1 | 3/2003 | Paczuski | 184/6.18 |
| 6,554,595 | B2 | 4/2003 | Hida et al. | 418/DIG. 1 |
| 6,588,228 | B2 | 7/2003 | Choi | 62/426 |
| 6,599,100 | B2 | 7/2003 | Abe et al. | 418/55.6 |
| 6,746,215 | B2 | 6/2004 | Tani et al. | 418/55.6 |
| 6,772,601 | B1 | 8/2004 | Davis et al. | 62/187 |
| 6,868,681 | B2 | 3/2005 | Woo et al. | 62/175 |
| 6,925,832 | B2 | 8/2005 | Kitaura et al. | 418/55.1 |
| 6,932,586 | B2 | 8/2005 | Furusho et al. | 418/55.6 |
| 6,951,628 | B2 | 10/2005 | Edam et al. | 264/401 |
| 6,955,064 | B2 | 10/2005 | Lee et al. | 62/453 |
| 6,962,058 | B2 | 11/2005 | Kim et al. | 62/175 |
| 7,032,404 | B2 | 4/2006 | Kim et al. | 62/262 |
| 7,036,331 | B2 | 5/2006 | Kim | 62/62 |
| 7,055,338 | B2 | 6/2006 | Ergarae et al. | 62/228.1 |
| 7,082,776 | B2 | 8/2006 | Shin | 62/186 |
| 7,112,046 | B2 * | 9/2006 | Kammhoff et al. | 418/55.1 |
| 7,114,345 | B2 | 10/2006 | Kim et al. | 62/296 |
| 7,121,106 | B2 | 10/2006 | Jung et al. | 62/324.6 |
| 7,311,501 | B2 * | 12/2007 | Wehrenberg et al. | 417/371 |
| 7,384,250 | B2 | 6/2008 | Shin et al. | 418/55.6 |
| 2003/0063986 | A1 | 4/2003 | Ginies et al. | 417/366 |
| 2005/0232800 | A1 * | 10/2005 | Kammhoff et al. | 418/55.6 |
| 2005/0265878 | A1 | 12/2005 | Ishida | 418/55.1 |
| 2006/0057012 | A1 * | 3/2006 | Park et al. | 418/55.6 |
| 2006/0065012 | A1 | 3/2006 | Kudo | 62/469 |
| 2006/0171831 | A1 | 8/2006 | Elson et al. | 418/55.6 |
| 2006/0216182 | A1 | 9/2006 | Kohsokabe et al. | 418/55.6 |
| 2007/0071627 | A1 * | 3/2007 | Lee et al. | 418/55.6 |

FOREIGN PATENT DOCUMENTS

| | | |
|---|---|---|
| JP | 63-192985 | 8/1988 |
| JP | 02-146285 | 6/1990 |
| JP | 03-160178 | 7/1991 |
| JP | 05-149274 | 6/1993 |
| JP | 06-002680 | 1/1994 |
| JP | 06-100186 | 4/1994 |
| JP | 06-235387 | 8/1994 |
| JP | 07-054788 | 2/1995 |
| JP | 07-197893 | 8/1995 |
| JP | 07-332265 | 12/1995 |
| JP | 08-151990 | 6/1996 |
| JP | 2001-207980 | 8/2001 |
| JP | 2001-329978 | 11/2001 |
| JP | 2002-138961 | 5/2002 |
| JP | 2003-003974 | 1/2003 |
| JP | 2003-293955 | 10/2003 |
| JP | 2004-100662 | 4/2004 |
| JP | 2005-201145 | 7/2005 |
| KR | 10-2000-0026721 | 5/2000 |
| KR | 10-2001-035692 | 5/2001 |
| KR | 10-2001-0057497 | 7/2001 |
| KR | 1020010059281 A | 7/2001 |
| KR | 10-2005-0062998 | 6/2005 |
| KR | 10-2005-0073532 | 7/2005 |

OTHER PUBLICATIONS

International Search Report, dated Dec. 28, 2007.
Korean Office Action, Feb. 27, 2008.
Korean Office Action dated Mar. 28, 2008.
Korean Office Action dated Feb. 25, 2008 corresponding to Korean Application No. 10-2007-0004553.
Korean Office Action dated Feb. 25, 2008 corresponding to Korean Application No. 10-2007-0004554.
Korean Office Action dated Sep. 11, 2008.
U.S. Office Action dated Sep. 16, 2009 for U.S. Appl. No. 12/048,337.
U.S. Office Action dated Nov. 13, 2009 for U.S. Appl. No. 11/930,515.
U.S. Office Action dated Dec. 18, 2009 for U.S. Appl. No. 11/933,534.
U.S. Office Action dated Mar. 16, 2010 for U.S. Appl. No. 12/048,337.
U.S. Office Action dated May 5, 2010 for U.S. Appl. No. 11/933,534.

* cited by examiner

COMPRESSOR AND OIL SEPARATION DEVICE THEREFOR

The application claims priority to Korean Application No. 10-2007-0018679 filed in Korea on Feb. 23, 2007, which is herein incorporated by reference in its entirety.

BACKGROUND

1. Field

A compressor and an oil separation device therefor are disclosed herein.

2. Background

Compressors are known. However, they have various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
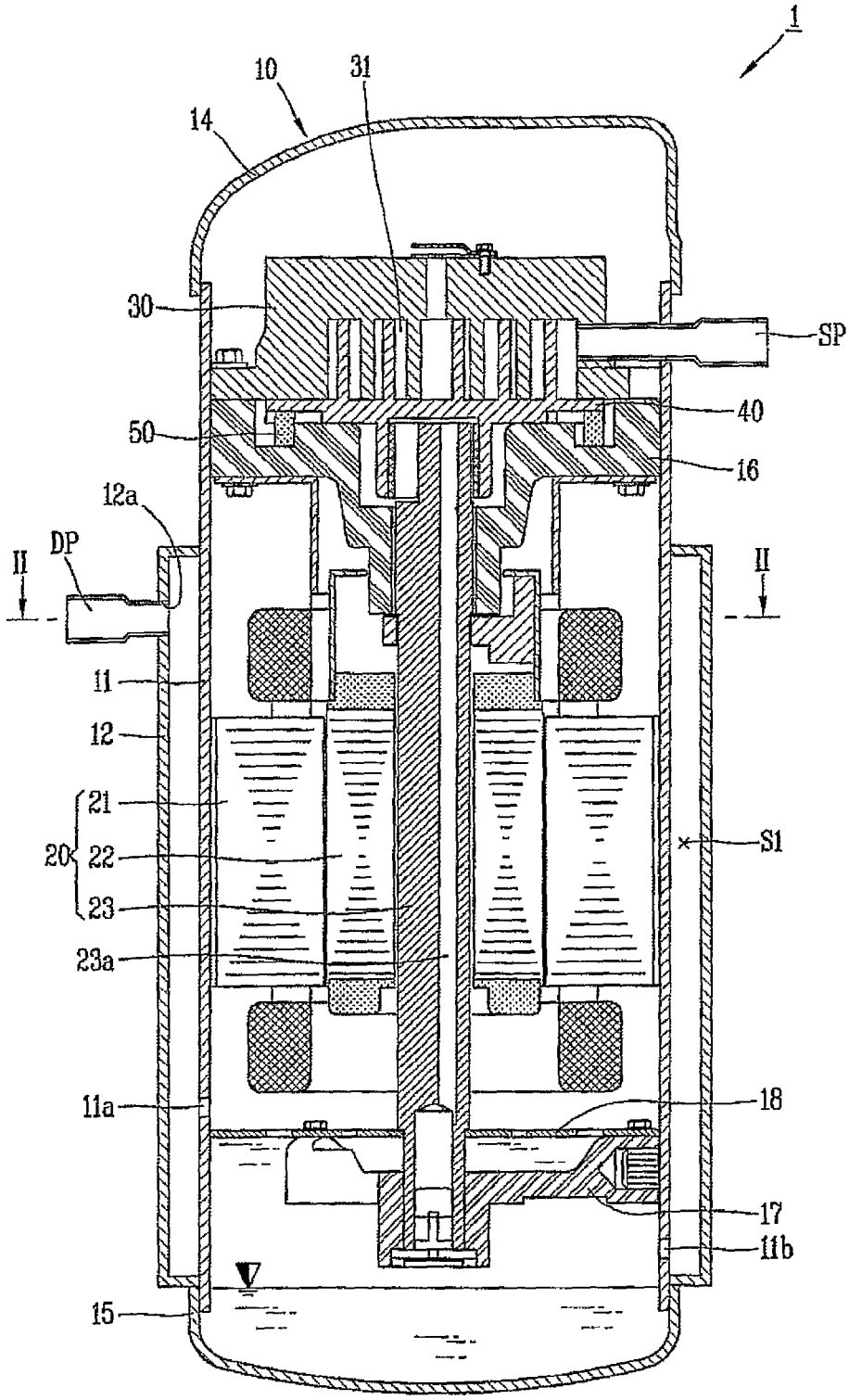
FIG. 1 is a longitudinal cross-sectional view of a scroll compressor according to an embodiment.

In general, a compressor converts mechanical energy into compressive energy to compress a fluid. Compressors may be categorized into various types, such as a reciprocating type, a rotary type, a vane type, and a scroll type according to the method for compressing the fluid.

A scroll compressor may include a driving motor to generate a force in an inner space of a sealed case and a compression device driven by a driving motor to compress a refrigerant. In the compression device, an orbiting scroll, which is engaged with a fixed scroll, performs an orbiting motion. A plurality of paired compression chambers may be formed by the fixed and orbiting scrolls. As the compression chambers move toward a center of the scroll, a refrigerant may be consecutively compressed and discharged to a discharge space.

The inner space of the case may be filled with a certain amount of oil. The oil may be sucked and scattered by centrifugal force generated when the driving motor is rotated, thereby cooling the driving motor and the compression device. At the same time, the oil may be partially sucked into the compression device to lubricate a sliding surface or a friction portion between the fixed scroll and the orbiting scroll.

However, when such a scroll compressor is used in an air conditioning system, a refrigerant of high temperature and high pressure, which is discharged from the compressor, contains a certain amount of refrigerating machine oil. In particular, when a high-speed operation is performed by using an inverter compressor, and if a rotational speed of the driving motor is greater than a certain frequency (Hz), an amount of discharged oil increases by geometric progression. This may cause reduced performance of a heat exchanger. Further, a reliability of the compressor or the system may be reduced when oil is not sufficient to supply to the friction portion, as the amount of oil recollected from a cycle decreases.

In order to solve these problems, an air conditioning system may separate oil from a refrigerant using an oil separation device, which is additionally attached to a compressor discharge pipe side. The refrigerant may be passed to the refrigerating cycle and the oil is returned to the inside of the compressor, enhancing performance of the cycle and improving the reliability of the compressor by obtaining a certain lubricating surface in the compressor.

However, the reliability of such a compressor may be highly reduced due to the shortage of oil. Further, the manufacturing cost may increase due to the need for additional components. Regarding installation, a separate space may be required to install the oil separation device. Further, a thermodynamic loss may occur when separated oil of high temperature and high pressure is bypassed toward the suction side of the compressor.

Further, a pipe connecting the compressor and the additional oil separation device may be required. As a result, the pipe of the refrigerating cycle may become complicated and long in length, causing a price increase. In addition, while the refrigerant discharged from the compressor passes through the oil separation device, the pressure decreases, thereby reducing performance of the refrigerating cycle system.

Figure 2:
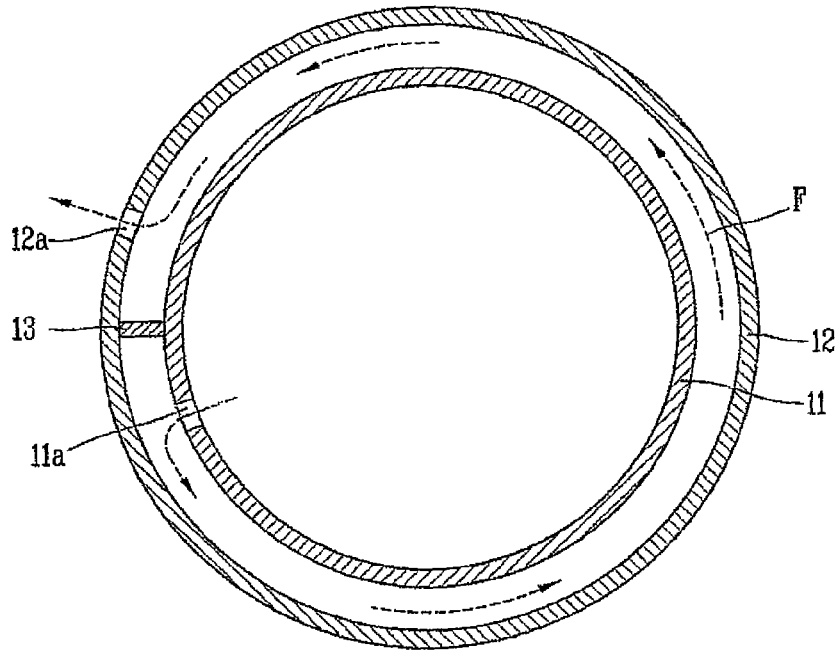
FIG. 2 is a cross-sectional view showing an oil separation device taken along line 'II-II' of FIG. 1.
Figure 3:
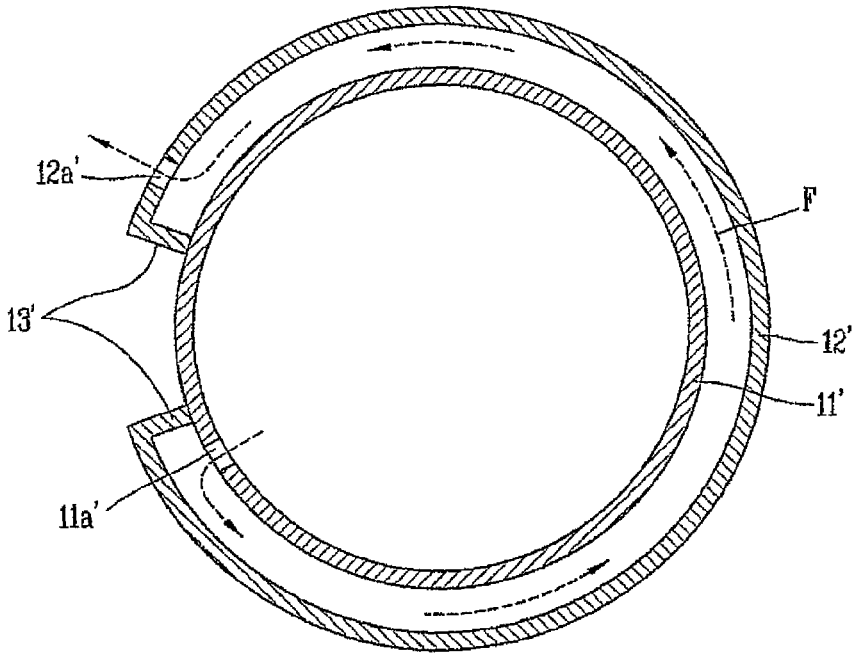
FIGS. 3 and 4 are plan views showing embodiments of the oil separation device in FIG. 2.
Figure 4:
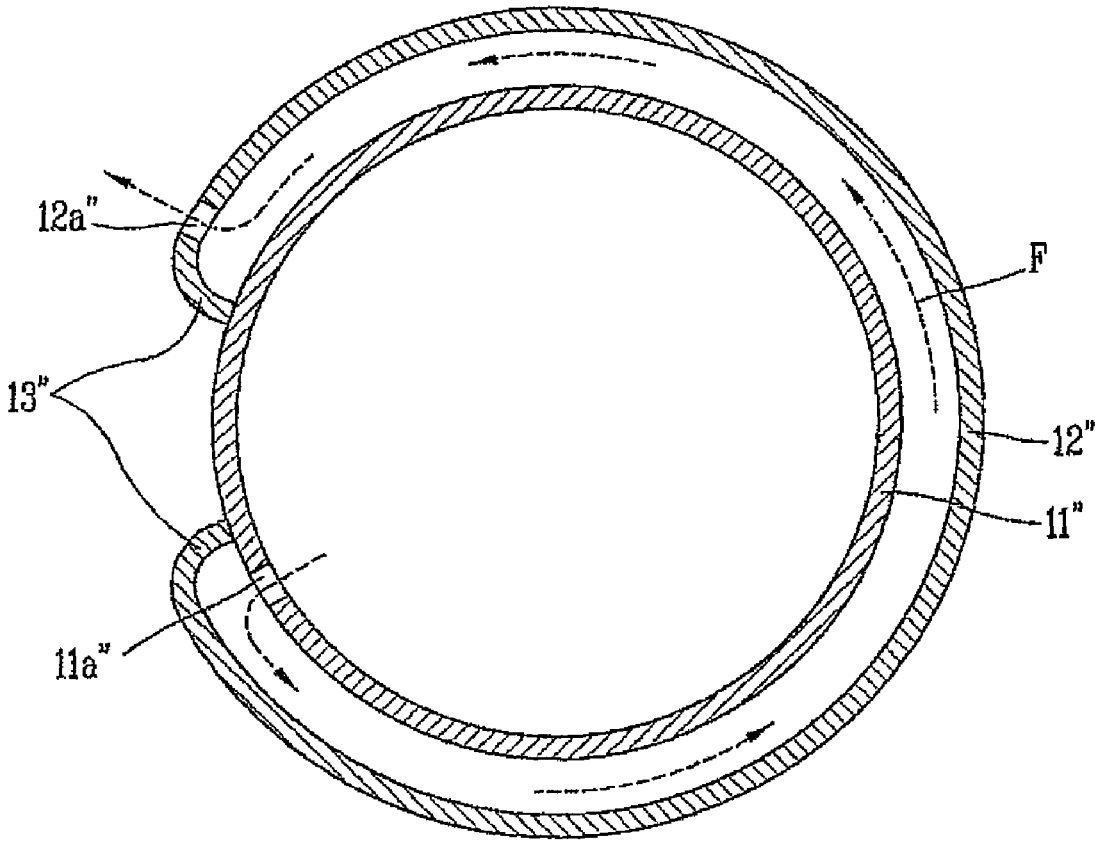

FIG. 1 is a longitudinal cross-sectional view of a scroll compressor according to an embodiment. FIG. 2 is a cross-sectional view the oil separation device taken along line 'II-II' of FIG. 1. FIGS. 3 and 4 are plan views showing embodiments of the oil separation device of FIG. 2.

As shown in FIG. 1, the scroll compressor 1 according to an embodiment may include a first case 11, a motor 20 installed in the first case 11, a rotational shaft 23 rotated by the motor 20 and having an oil path 23*a* therein, a main frame 16 fixed to the first case 11 and supporting the rotational shaft 23, an orbiting scroll 40 supported by the main frame 16 and orbited by the rotational shaft 23, a fixed scroll 30 forming a compression chamber 31 by engaging with the orbiting scroll 40, and a second case 12 installed at an outside of the first case 11. The case 10 of the scroll compressor 1 may include the first case 11 having a certain space therein and the second case 12 installed at the outside of the first case 11. A compression device and the motor 20 may be installed in the case 10. The case 10 may include an upper cap 14 and a lower cap 15.

The scroll compressor 1 shown in FIG. 1 is a high-pressure type scroll compressor in which the inside of the case 10 is filled with a discharged refrigerant of high temperature and high pressure. The compression device may be formed in an upper portion of the case 10 and may include the fixed scroll 30 and the orbiting scroll 40 forming the compression chamber 31 by being engaged with a wrap of the fixed scroll 30. The orbiting scroll 40 may be supported by the main frame 16 mounted at a lower portion thereof. An Oldham ring 50 may be inserted between the orbiting scroll 40 and the main frame 16 to prevent the orbiting scroll 40 from rotating on its axis.

The motor 20 may be mounted at a lower portion of the compression device. The motor 20 may include a stator 21 fixed to an inner surface of the first case 11, a rotor 22 installed at an inside of the stator 21 with an air gap therebetween, and the rotational shaft 23 forcibly inserted into a center of the rotor 22. An oil path 23*a* may be penetratingly formed in the inside of the rotational shaft 23 to suck oil stored in a lower portion of the case 10.

An upper end of the rotational shaft 23 may be supported by the main frame 16, and a lower end of the rotational shaft 23 may be supported by a sub-frame 17 fixed to the lower portion of the first case 11. An anti-foaming plate 18 may be installed at the upper side of the sub-frame 17 to prevent foam, which is generated by oil stored in the lower portion of the case 10, from being transferred to the motor 20. However, the anti-foaming plate 18 may not be provided in a compressor in which the motor 20 or the rotational shaft 23 is not required to rotate at a high-speed.

A suction pipe SP may be penetratingly installed at one side of the fixed scroll 30 and may penetrate the case 10. A discharge pipe DP may be penetratingly formed at the second case 12.

The first case 11 and the second case 12 may serve as an oil separation device that separates oil contained in the refrigerant which is sucked into or discharged from the scroll compressor 1. A refrigerant inlet 11*a* through which an oil-containing refrigerant may be sucked, and an oil recollecting member 11*b* that recollects the oil separated from the refrigerant may be formed in the first case 11. A refrigerant outlet 12*a* through which an oil-separated refrigerant may be discharged may be provided in the second case 12.

That is, the oil separation device may include the first case 11 including the refrigerant inlet 11*a* into which a refrigerant mixed with oil may be sucked and the oil recollecting member 11*b* through which oil separated from the refrigerant may flow, and the second case 12 installed at the outside of the first case 11 and including the refrigerant outlet 12*a* through which a refrigerant separated from oil may be discharged and supplied to a refrigeration cycle. The discharge pipe DP may be installed to communicate with the refrigerant outlet 12*a*. This oil separation device described above may be applied to a high-pressure type scroll compressor.

Further, a plurality of each of the refrigerant inlet 11*a*, the oil recollecting member hole 11*b*, or the refrigerant outlet 12*a* may be provided. An oil separating space S1 may be provided between the first case 11 and the second case 12 so as to allow the flow of the sucked refrigerant.

Detailed configurations of the oil separation device will be explained with reference to FIGS. 2 through 4.

Referring to FIG. 2, the oil separation device may be configured at an outer circumferential portion of the compression device and the motor 20, and may have a double-shell structure having the oil separating space S1 therein. That is, the first case 11 and the second case 12 may form the oil separating space S1 therebetween by being disposed a certain or predetermined distance from each other.

The refrigerant inlet 11*a* may be formed in the first case 11 to suck the discharged refrigerant at high temperature and high pressure filled inside the case 10 into the oil separating space S1. The refrigerant outlet 12*a* may be formed in the second case 12 to discharge the oil-separated refrigerant from the oil separating space S1 to the refrigerating cycle or refrigerating system.

A flow-guiding member 13 may be formed in the oil separating space S1 to be disposed between the refrigerant inlet 11*a* and the refrigerant outlet 12*a*. That is, when viewed from the upper portion of the oil separation device, the flow-guiding member 13 may be formed between the refrigerant inlet 11*a* and the refrigerant outlet 12*a* and also installed in the oil separating space S1.

The flow-guiding member 13 may be in the shape of a separating plate, which may be installed between the first case 11 and the second case 12. The flow-guiding member 13 in the shape of the separating plate may be formed in a longitudinal direction of the first case 11 and the second case 12 (that is, a vertical direction) and may divide the oil separating space S1.

Meanwhile, the flow-guiding member 13 may be provided in a spiral shape wound around the first case 11 and the second case 12 in a longitudinal direction. Accordingly, such spiral-shaped flow-guiding member 13 may make the refrigerant flow smoothly and fully utilize the entire oil separating space S1.

The flow-guiding member 13 may serve to flow the refrigerant sucked into the refrigerant inlet 11*a* in one direction. As shown in FIG. 2, since the flow-guiding member 13 may be formed at a position adjacent to the refrigerant inlet 11*a*, a refrigerant flowing in a clockwise direction may be blocked by the flow-guiding member 13 in the shape of the separating plate, so as to flow only in a counterclockwise direction F.

In addition, the refrigerant outlet 12*a* may be formed at a position opposite to the refrigerant inlet 11*a* with respect to of the flow-guiding member 13. A refrigerant flowing in a counterclockwise direction may be discharged from the scroll compressor 1 through the refrigerant outlet 12*a*.

While the refrigerant sucked into the oil separating space S1 of the oil separation device flows in the counterclockwise direction, the refrigerant performs a cyclonic flow due to the flow-guiding member 13. At the same time, the refrigerant turns around an outer circumference of the first case 11 and collides with each wall surface of the first case 11 and the second case 12. During this collision, oil particles contained in the refrigerant collide and are lumped together with each other due to surface tension, thereby forming oil drops. These oil drops are separated from the refrigerant and then flow downwards along the wall surfaces of the first case 11 and the second case 12. The cyclonic flow of the refrigerant may be enhanced by forming the flow-guiding member 13 to have a wound spiral shape. The refrigerant performs the cyclonic flow due to the flow-guiding member 13. However, without being limited to such a flow shape, a flow need only be sufficient for an oil-contained refrigerant to remain in the oil separating space S1 long enough due to the flow-guiding member 13 to separate the oil from the refrigerant.

The oil may move to an oil storage space formed at the lower portion of the case 10 through the oil recollecting hole 11*b* formed at the lower portion of the oil separating space S1. To move the oil separated by the processes to the oil storage space through the oil recollecting hole 11*b*, a separate oil recollecting member may be further provided. The oil recollecting member may be, for example, a pump, or a fan.

Further, the oil may be separated from the oil-contained refrigerant in the oil separating space S1 by momentarily reducing a flow rate of the refrigerant due to changing a cross-sectional area of the oil separating space S1.

The oil separation device shown in FIG. 3 is another embodiment, and the configuration of the flow-guiding member 13' is different from that in FIG. 2. In the flow-guiding members 13' of the oil separation device shown in FIG. 3, ends of the second case 12' may be disposed apart from each other. That is, one end of the second case 12' may be connected onto the surface of the first case 11' and another end of the second case 12' may be connected onto the surface of the first case 11' spaced from the one end of the second case 12'.

The flow-guiding members 13' may be formed by bending both ends of the second case 12'. The refrigerant inlet 12*a*' and the refrigerant outlet 11*a*' may be formed at a position adjacent to the flow-guiding members 13' each formed by bending the second case 12'.

As shown in FIG. 3, a clockwise flow of a refrigerant sucked into the refrigerant inlet 11*a*' may be blocked by the bent flow-guiding members 13' of the second case 12'. Accordingly, the refrigerant flows in a counterclockwise direction F and then may be discharged from the compressor through the refrigerant outlet 12*a*'. The process or the principle of separating oil from the refrigerant is the same as that of the oil separation device shown in FIG. 2, and repetitive detailed explanations are therefore omitted.

FIG. 4 illustrates another embodiment of an oil separation device, which is the same as the oil separation device in FIG. 3 except for the configuration of the flow-guiding member, and also adapts the same principle of separating oil as shown in FIG. 3. The flow-guiding members 13" of the oil separation device shown in FIG. 4 may be formed such that both ends of the second case 12" may be spaced apart from each other and the ends may be connected onto the surface of the first case 11". Both ends of the second case 12" may be curved instead of being bent and may then be connected to the first case 11". Therefore, the flow-guiding members 13" may be formed to have curved surfaces.

The formation of the flow-guiding members 13" with the curved surfaces may prevent the generation of noise, which may be generated during a process in which the refrigerant blocked while flowing in a clockwise direction after being sucked into the refrigerant inlet 11*a*" then flows (is bypassed) in a counterclockwise direction, and the generation of foam in the oil contained in the refrigerant.

Returning to FIG. 1, the refrigerant outlet 11*a* may be configured at the upper portion of the second case 12. The oil-separated refrigerant has a relatively low specific gravity or light weight. Accordingly, it may be more efficient in a refrigerating cycle system to configure the refrigerant outlet 12*a* at the upper portion of the second case 12.

The oil recollecting hole 11*b* may be configured at a lower portion of the first case 11. Since the oil may be stored in a storage space formed at a lower portion of the case 10, it may be effective to form the oil recollecting member 11*b* at the lower portion of the first case 11 such that the oil recollecting member 11*b* may be close to the storage space.

The refrigerant inlet 11*a* may be formed between the refrigerant outlet 12*a* and the oil recollecting member 11*b*. That is, the refrigerant inlet 11*a* may be configured at a middle height (position) between the refrigerant outlet 12*a* and the oil recollecting member 11*b* from the lower end of the first case 11 or the second case 12.

The first case 11 may be integrally formed with the second case 12. Alternatively, the first case 11 and the second case 12 may be configured as separate components to thereafter be coupled to each other by, for example, welding.

That is, the first and second cases 11 and 12 may be originally formed as one component, or may be integrated with each other by a post-process, such as welding, after being separately configured. Accordingly, the first and second cases 11 and 12 may be modularized so as to improve assembly and productivity when applying them to a compressor. Namely, a module (or an unit) of the first and second cases 11 and 12 having the oil separation device may be prepared and other components of the compressor may be mounted in the module, such that a process of separately fabricating or installing the oil separation device may not be performed.

The refrigerant inlet 11*a* may be configured at a higher position than the anti-foaming plate 18 installed at the sub frame 17 to support the lower portion of the rotational shaft 23 or configured at least at the same height as the anti-foaming plate 18. By forming the refrigerant inlet 12*a* at the higher position than the anti-foaming plate 18 or the same height thereas, it may be possible to prevent the oil-contained refrigerant from coming into contact (being mixed) with the oil stored in the lower portion of the case 10 provided at the lower portion of the anti-foaming plate 18.

If the compressor does not have to be rapidly rotated, foam may be generated less during the process of sucking up the oil stored in the lower portion of the case 10. In this case, the refrigerant inlet 11*a* may be configured at a lower position than the anti-foaming plate 18. In the case of a compressor without the anti-foaming plate 18, the position to form the refrigerant 11*a* may be selected more freely. If the refrigerant inlet 11*a* is configured at the lower position than the anti-foaming plate 18, the refrigerant may come in contact with the oil stored in the lower portion of the case 10 and further contain oil stored in the case 10. Accordingly, it may be more effective to form the refrigerant inlet 11*a* at the higher position than the anti-foaming plate 18 or at the same height thereas.

Figure 5:
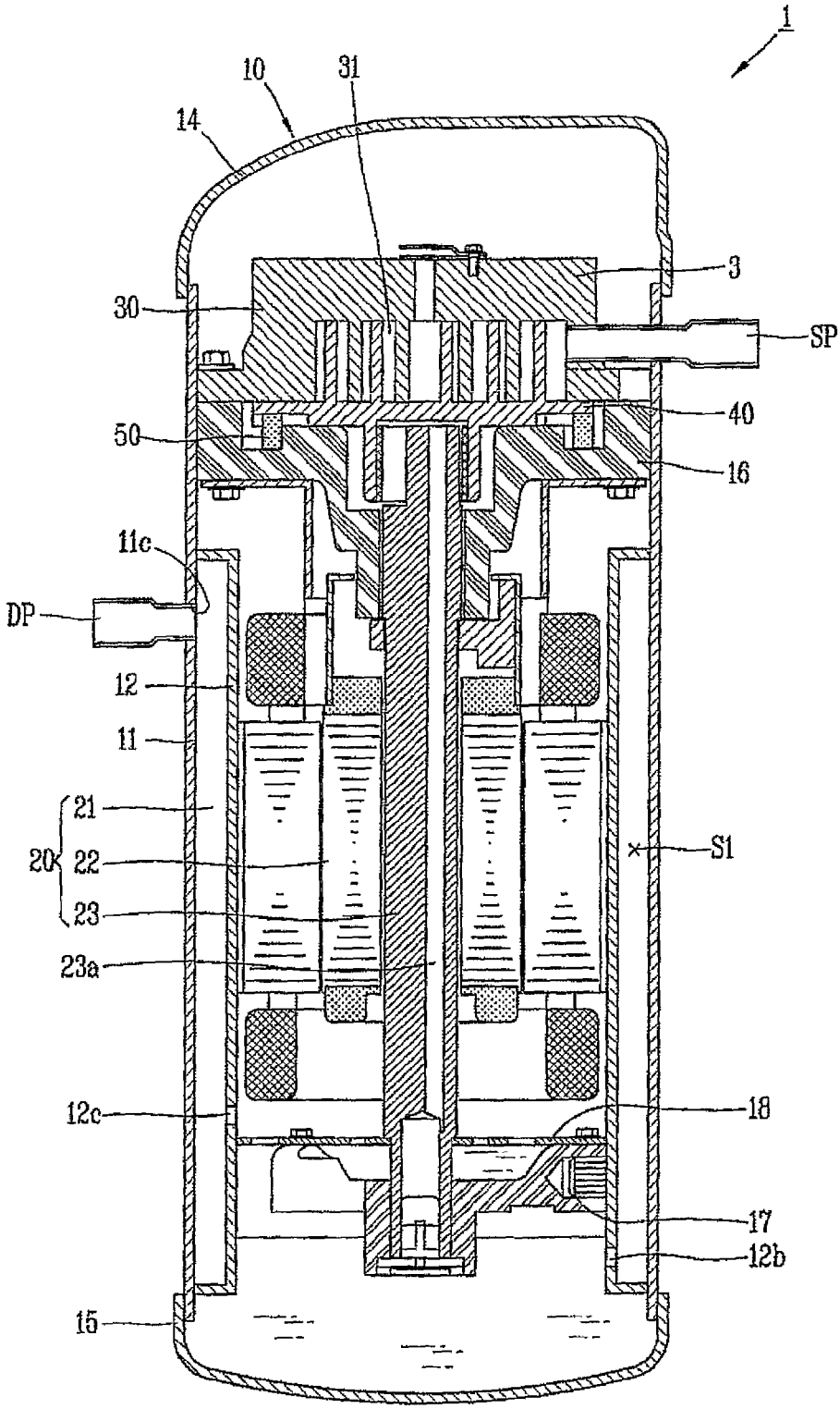
FIG. 5 is a longitudinal cross-sectional view of a scroll compressor according to another embodiment.

FIG. 5 is a longitudinal sectional view illustrating a scroll compressor in accordance with another embodiment. The scroll compressor in FIG. 5 and the scroll compressor in FIG. 1 are different from each other in the structure of the oil separation device. That is, the scroll compressor shown in FIG. 1 has the oil separation device with the outer second case 12 protruded to the outside, while the scroll compressor shown in FIG. 5 has the oil separation device with the second case 12 not protruded to the outside. Except for this structure, the scroll compressors shown in FIGS. 1 and 5 have the same configuration.

If the second case 12 of the oil separation device is protruded to the outside as shown in the scroll compressor of FIG. 1, it is not easy to minimize an outdoor unit of an air conditioner in which the scroll compressor is installed. In order to solve this problem, as shown in FIG. 5, it may be effective to install the scroll compressor having the oil separation device with the second case 12 which is not protruded to the outside.

In the case of using a case having the same size, namely, having the same maximum outer diameter, the motor 20 mounted in the scroll compressor shown in FIG. 5 may be smaller than the motor of the scroll compressor in FIG. 1, which may decrease its output. Therefore, an appropriate scroll compressor may be effectively selected by considering a desired output, and a position to install the compressor.

The oil separation device and the scroll compressor having the same according to embodiments disclosed herein may be applied to a high-pressure type compressor in which the case 10 is filled with a discharged refrigerant at high temperature and high pressure. The oil separation device integrally formed with the scroll compressor may be applied not only to the high-pressure type scroll compressor but also to a low-pressure type compressor in which a sealed case is filled with a sucked refrigerant at low temperature and low pressure.

Figure 6:
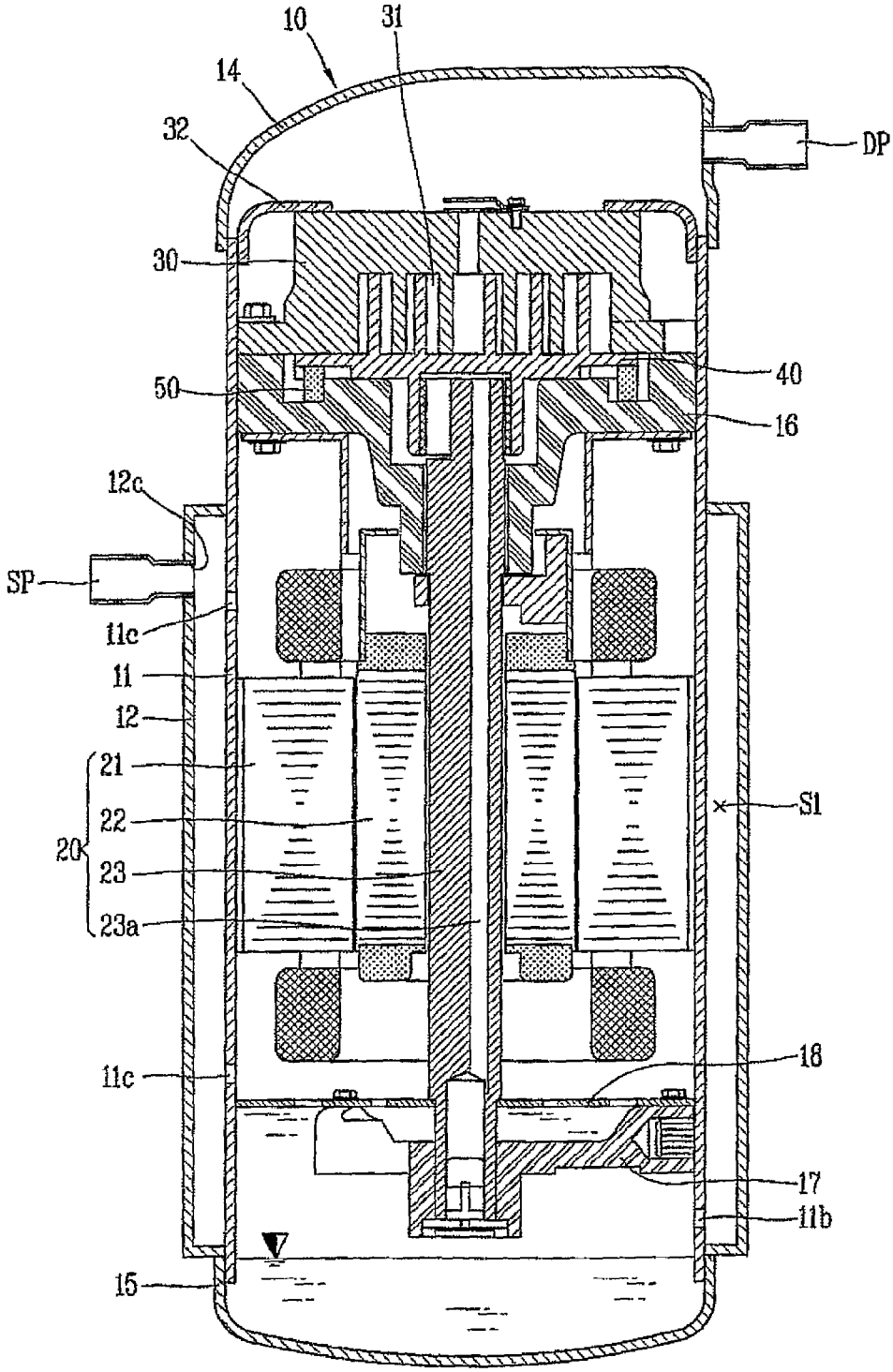
FIG. 6 is a longitudinal cross-sectional view of a scroll compressor according to still another embodiment.

FIG. 6 is a longitudinal sectional view of a scroll compressor, in particular, a low-pressure type scroll compressor, in accordance with another embodiment. That is, the scroll compressor of FIG. 6 is a low-pressure type compressor because the case 10 is filled with a sucked refrigerant of low temperature and low pressure sucked through the suction pipe SP.

The low-pressure type scroll compressor may be configured such that the discharged refrigerant at high temperature and high pressure is collected at a high/low pressure separating plate 32 installed at an upper surface of the fixed scroll 30 and an upper space thereof, and the discharged refrigerant collected in the space may be discharged through the discharge pipe DP. The low-pressure type scroll compressor may have the same configuration as that of the high-pressure type scroll compressor except for the operation of the refrigerant suction and the refrigerant discharge, detailed explanation of which will be omitted accordingly. However, the configuration of an oil separation device in the low-pressure type scroll compressor may be different from that of the oil separation device in the high-pressure type scroll compressor. The difference therebetween will now be described.

The oil separation device applied to the low-pressure type scroll compressor shown in FIG. 6 may include a second case 12 having a refrigerant inlet 12*c* into which the oil-contained refrigerant may be sucked, and a first case 11 installed at the inside of the second case 12 and including an oil recollecting hole 11*b* to recollect the oil separated from the refrigerant sucked into the refrigerant inlet 12*c* and a refrigerant outlet 11*c* to discharge the oil-separated refrigerant to a compression device. The oil contained in the refrigerant sucked into the refrigerant inlet 12*c* may be the oil which has not been recollected from the discharged refrigerant. The oil circulates the cycle with the refrigerant to be sucked into the refrigerant inlet 12*c*. The refrigerant outlet 11*c* may be formed in the first case 11 in plurality, so as to allow the refrigerant to be sufficiently supplied to the compression device.

An oil separating space S1 may be formed between the second case 12 and the first case 11. A flow-guiding member 13 may be provided in the oil separating space S1 so as to make the refrigerant perform a cyclonic flow. The flow-guiding member 13 may be provided in a spiral shape wound around the first and second cases 11 and 12 in their length directions.

The refrigerant may perform the cyclonic flow due to the flow-guiding member 13. However, the flow of the refrigerant may not be limited to a cyclonic flow, but rather a flow need only be sufficient for the oil-contained refrigerant to remain in the oil separating space S1 long enough due to the flow-guiding member 13 to separate the oil from the refrigerant.

In addition, when using the oil separation device applicable to the low-pressure type scroll compressor as described above, a separate pipe may be formed to connect the discharge pipe DP to the second case 12 such that the discharged refrigerant further containing oil may be sucked into the oil separating space S1, thereby separating the oil therein. In the low-pressure type scroll compressor having the oil separation device, the method of separating the oil from the refrigerant may be the same as that in the high-pressure scroll compressor having been mentioned before. Accordingly, description thereof will not be repeated.

Since the discharged refrigerant at high temperature and high pressure contains the oil supplied to the compression device and the sucked refrigerant at low temperature and low pressure contains the oil present in the refrigerating cycle system or the oil stored in the lower portion of the case, the integral oil separation device may be applied both to the high-pressure type scroll compressor and to the low-pressure type scroll compressor.

As described above, embodiments provide an oil separation device integrated with the compressor. Accordingly, no pipe for connecting the compressor and the oil separation device to each other is separately required, thereby reducing fabrication costs. In addition, by employing the integral oil separation device, no installation space is separately required for the oil separation device, thereby improving the facilitation of the installation.

Also, embodiments provide the scroll compressor capable of improving the reliability of the refrigerating cycle system by preventing a thermodynamic loss which may be generated during a process of bypassing the separated oil toward the suction side of the compressor.

The compressor and oil separation device therefor according to embodiments disclosed herein may reduce production costs, facilitate installation, and prevent the overheating of a sucked refrigerant by integrating the oil separation device with the compressor.

In accordance with one embodiment broadly described herein, there is provided an oil separator that includes a first case having a refrigerant inlet into which a refrigerant mixed with an oil is sucked and an oil recollecting member through which an oil separated from the refrigerant flows, and a second case configured at the outside of the first case and having a refrigerant outlet through which a refrigerant separated from an oil is discharged. With such a configuration, a motor part and a compression part of the scroll compressor are mounted at the inside of the inner case. Accordingly, the oil separator may be integrally formed with the scroll compressor.

Further, an oil separating space may be configured between the first and second cases so as to make the sucked refrigerant flow therein. By sucking the oil-contained refrigerant into the oil separating space and by retaining the refrigerant there for a certain period of time, the separation of oil from the refrigerant is obtained, and thereby oil may be effectively separated from the refrigerant.

A flow-guiding member may be formed between the first and second cases. Both ends of the second case may be apart from each other. By forming the flow-guiding member or by forming both ends of the second case apart from each other, the refrigerant sucked into the oil separating space may flow in one direction and oil may be separated from the refrigerant during the refrigerant flow. The flow-guiding member may be formed as a plate shape installed in a longitudinal direction of the first and second cases. However, the flow-guiding member may not be limited to the plate shape, but rather, various other shapes may be implemented.

One end of the second case may be connected onto a surface of the first case, and another end of the second case may be connected onto a surface of the first case spaced from the one end of the second case. Accordingly, both ends of the second case may be apart from each other, thereby making the refrigerant flow in one direction.

The refrigerant outlet may be configured at an upper part of the second case, and the oil recollecting member may be configured at a lower part of the first case. Considering that the oil-separated refrigerant has a relatively low specific gravity or light weight, it may be advantageous to form the refrigerant outlet at the upper part of the second case for efficiency of the refrigerating cycle system. Since the oil may be stored in the storage space formed at the lower part of the compressor case, it may be effective to form the oil recollecting member at the lower part of the first case such that the oil recollecting member may be close to the storage space.

The refrigerant inlet may be formed between the refrigerant outlet and the oil recollecting member. The first case may be integrally formed with the second case, or the first case may be coupled to the second case by welding. That is, the first and second cases may be originally formed as one component, or may be integrated with each other by a post-process such as welding or the like after being separately configured. Accordingly, the first and second cases may be modularized so as to enhance assembly and productivity when applying them to a compressor.

In accordance with another embodiment broadly described herein, a scroll compressor is provided that includes a first case, a motor installed in the first case, a rotational shaft, rotated by the motor, having an oil path therein, a frame configured in the first case and supporting the rotational shaft, an orbiting scroll supported by the frame and orbited by the rotational shaft, a fixed scroll forming a compressing room by engaging with the orbiting scroll, and an oil separator including the first case and a second case configured at an outside of the first case. The first case may have a refrigerant inlet into which a refrigerant mixed with an oil is sucked and an oil recollecting member through which an oil separated from the refrigerant flows, and the second case may have a refrigerant outlet through which a refrigerant separated from an oil is discharged. The refrigerant inlet may be configured at a higher position than an anti-foaming plate installed at the sub-frame to support the lower part of the rotational shaft. By forming the refrigerant inlet at the higher position than the anti-foaming plate, it may be possible to prevent the oil-contained refrigerant from coming into contact or being mixed with the oil stored in the lower part of the anti-foaming plate.

The first case may be filled with a discharged refrigerant at high temperature and high pressure. That is, if the scroll compressor is a high-pressure type compressor, the first case may be filled with the discharged refrigerant.

An oil separating space may be formed between the second case and the first case. A flow-guiding member may be provided in the oil separating space so as to make the refrigerant perform a cyclonic flow. Since the oil-contained refrigerant performs the cyclonic flow by the flow-guiding member, the oil may be effectively separated.

In accordance with another embodiment broadly described herein, an oil separator is provided that includes a first case having an oil recollecting member through which oil separated from a refrigerant flows and a refrigerant outlet through which a refrigerant separated from the oil is discharged and a second case configured at the inside of the first case, having a refrigerant inlet into which a refrigerant mixed with an oil flows. Such an oil separator may be applied to a low-pressure type scroll compressor in which the inside of the compressor is filled with a sucked refrigerant at low temperature and low pressure.

An oil separating space may be formed between the second case and the first case. A flow-guiding member may be provided in the oil separating space so as to make the sucked refrigerant perform a cyclonic flow.

Although an exemplary scroll compressor is presented herein, for ease of discussion, it is well understood that the oil separation device according to embodiments disclosed herein may be equally applied to other types of compressors, or another application in which this type of oil separation is required and/or advantageous.

Figure 7:
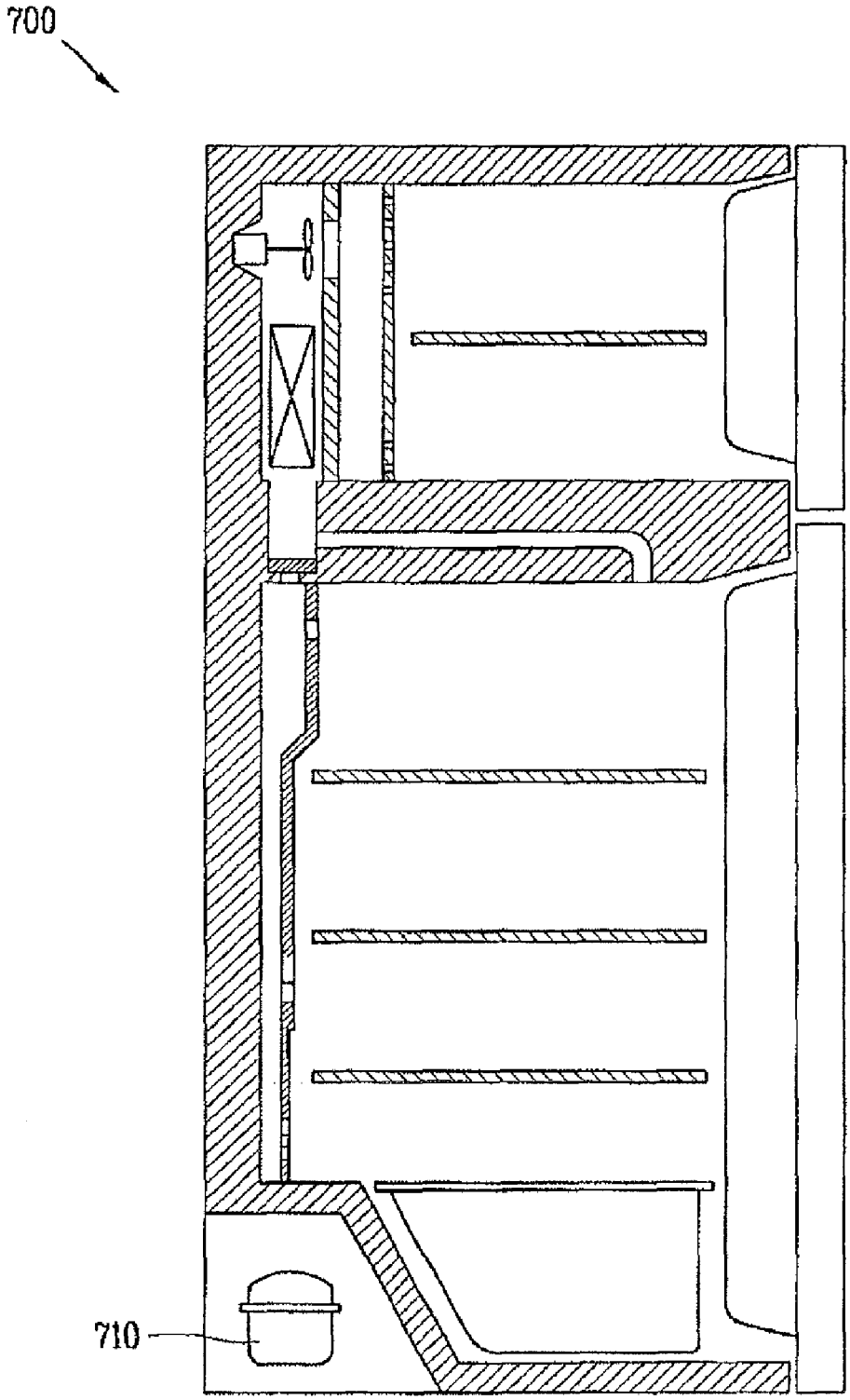
FIG. 7 is a cross-sectional view of a refrigerator/freezer showing a compressor having an oil separation device according to embodiments disclosed herein.

More specifically, the compressor and oil separation device therefor according to embodiments disclosed herein has numerous applications in which compression of fluid is required, and in different types of compressors. Such applications may include, for example, air conditioning and refrigeration applications. One such exemplary application is shown in FIG. 7, in which a compressor 710 having an oil separation device according to embodiments disclosed herein is installed in a refrigerator/freezer 700. Installation and functionality of a compressor in a refrigerator is discussed in detail in U.S. Pat. Nos. 7,082,776, 6,955,064, 7,114,345, 7,055,338, and 6,772,601, the entirety of which are incorporated herein by reference.

Figure 8:
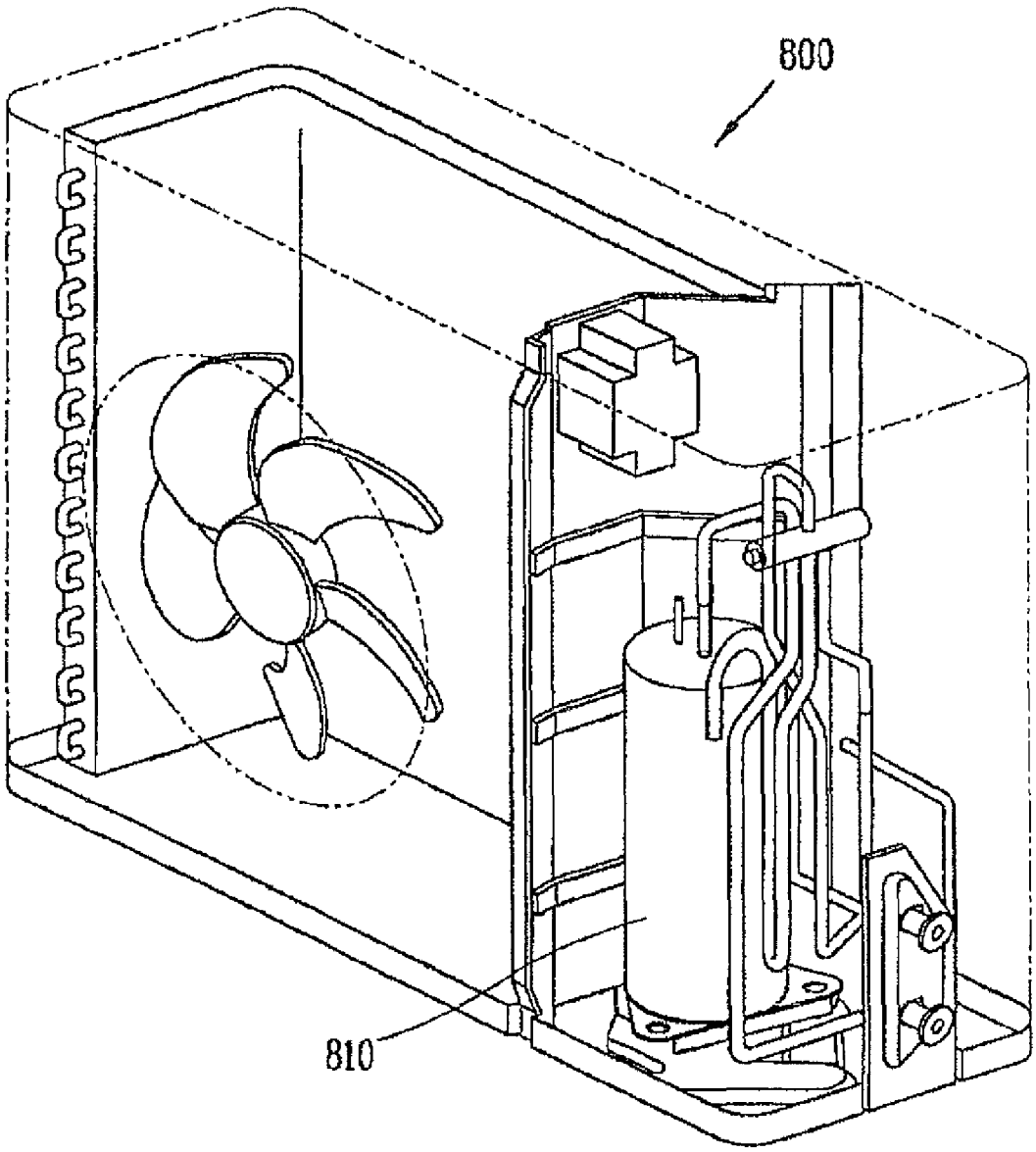
FIG. 8 is a perspective view of an outdoor unit of an air conditioner showing a compressor having an oil separation device according to embodiments disclosed herein.

Another such exemplary application is shown in FIG. 8, in which a compressor 810 having an oil separation device according to embodiments disclosed herein is installed in an outdoor unit of an air conditioner 800. Installation and functionality of a compressor in a refrigerator is discussed in detail in U.S. Pat. Nos. 7,121,106, 6,868,681, 5,775,120, 6,374,492, 6,962,058, 6,951,628, and 5,947,373, the entirety of which are incorporated herein by reference.

Figure 9:
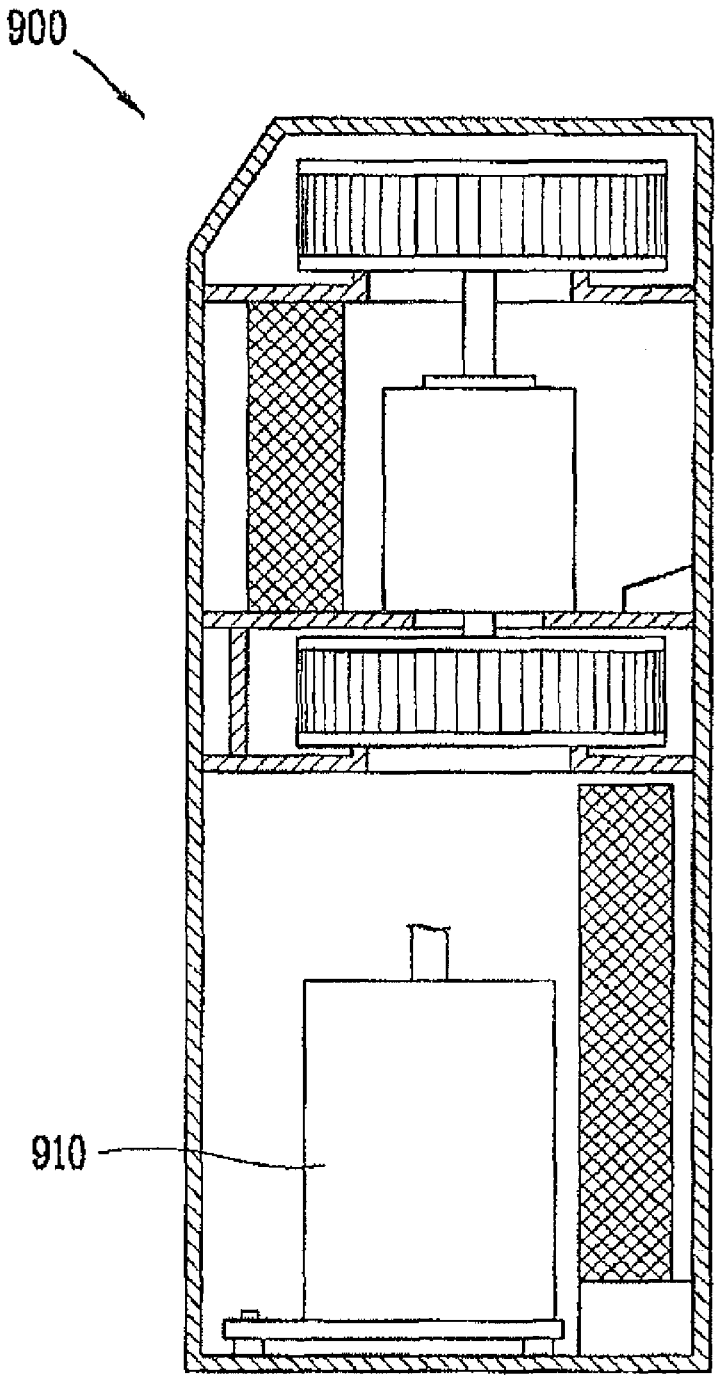
FIG. 9 is a cross-sectional view of a single, integrated air conditioning unit showing a compressor having an oil separation device according to embodiments disclosed herein.

Another such exemplary application is shown in FIG. 9, in which a compressor 910 having an oil separation device according to embodiments disclosed herein is installed in a single, integrated air conditioning unit 900. Installation and functionality of a compressor in a refrigerator is discussed in detail in U.S. Pat. Nos. 7,032,404, 6,412,298, 7,036,331, 6,588,228, 6,182,460, and 5,775,123, the entirety of which are incorporated herein by reference.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a first case;

a compression device having a compression chamber within the first case configured to receive, compress, and discharge a refrigerant, wherein the compression chamber is in direct connection with a suction pipe of the compressor; and an oil separation device that surrounds the first case configured to receive the refrigerant discharged from the compression device and separate oil therefrom, wherein the oil separation device comprises a second case configured to surround at least a portion of the first case to form an oil separation space therebetween, wherein the refrigerant is received into the oil separation space and circulates along the oil separation space to separate oil from the refrigerant, and wherein an input hole is formed in the first case through which the refrigerant discharged from the compression device is received into the oil separation space, and a discharge hole is formed in the second case that is connected with a discharge pipe of the compressor through which the refrigerant is discharged from the compressor.

2. The compressor of claim 1, wherein the second case comprises an arc shaped portion that surrounds an outer surface of a portion of the first case.

3. The compressor of claim 2, further comprising a member that forces the refrigerant to circulate along the oil separation space.

4. The compressor of claim 1, wherein the oil separation device further comprises an oil outlet hole formed in the first case.

5. A scroll compressor comprising the compressor of claim 1.

6. The compressor of claim 3, wherein the member is configured in a longitudinal direction of the first case and the second case, and entirely divides the oil separating space between the input hole and the discharge hole.

* * * * *